US012172261B2

(12) United States Patent
East et al.

(10) Patent No.: US 12,172,261 B2
(45) **Date of Patent: *Dec. 24, 2024**

(54) BLADE SHARPENERS

(71) Applicant: THE GREAT STATES CORPORATION, Indianapolis, IN (US)

(72) Inventors: Charles East, Muncie, IN (US); Rhett Thompson, Muncie, IN (US); Michael Kersey, Noblesville, IN (US)

(73) Assignee: THE GREAT STATES CORPORATION, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/457,728

(22) Filed: Aug. 29, 2023

(65) Prior Publication Data

US 2023/0398652 A1 Dec. 14, 2023

Related U.S. Application Data

(63) Continuation of application No. 16/690,191, filed on Nov. 21, 2019, now Pat. No. 11,865,662.

(51) Int. Cl.
*B24B 3/42* (2006.01)
*B24B 3/36* (2006.01)
(Continued)

(52) U.S. Cl.
CPC ..... *B24B 3/42* (2013.01); *B24B 3/365* (2013.01); *B24B 3/50* (2013.01); *B24B 3/54* (2013.01);
(Continued)

(58) Field of Classification Search
CPC .... B24B 3/54; B24B 3/42; B24B 3/36; B24B 3/365; B24B 3/543; B24B 3/50;
(Continued)

(56) References Cited

U.S. PATENT DOCUMENTS 1,165,245 A 12/1915 Goodwin
1,894,579 A 1/1933 Blankner
(Continued)

FOREIGN PATENT DOCUMENTS

GB 2185919 A 8/1987
JP 2005279869 A 10/2005
(Continued)

OTHER PUBLICATIONS

EPO, Extended European Search Report for corresponding EP Patent Application No. 20208726.8, dated Mar. 24, 2021, 9 pages.
(Continued)

*Primary Examiner* — Makena S Markman
(74) *Attorney, Agent, or Firm* — NK Patent Law

(57) ABSTRACT

A blade sharpener for use with a powered rotary tool having a rotatable sharpening element includes a main body having a bore for receiving the powered rotary tool, where the bore extends through the main body along an axis and the main body has a first channel for receiving a blade to be sharpened. The first channel is perpendicular to the rotary axis and opens into the bore to permit a blade to engage the sharpening element. The blade sharpener also includes a guide having a guide channel for receiving a blade to be sharpened where the guide is pivotally attached to the main body to accommodate any curvature of a blade to be sharpened as the blade sharpener follows along the blade.

13 Claims, 6 Drawing Sheets

(51) Int. Cl.

| | |
|---|---|
| ***B24B 3/50*** | (2006.01) |
| ***B24B 3/54*** | (2006.01) |
| ***B24D 15/06*** | (2006.01) |
| ***B24D 15/08*** | (2006.01) |

(52) U.S. Cl.
CPC ..... *B24D 15/06* (2013.01); *B24D 15/08* (2013.01); *B24D 15/082* (2013.01); *B24D 15/084* (2013.01)

(58) Field of Classification Search
CPC .... B24D 15/081; B24D 15/08; B24D 15/084; B24D 15/082; B24D 15/06; B24D 15/065; B24D 15/04; B24D 15/063; B24D 15/068
USPC ..... 451/555, 349, 321, 45, 556, 162, 169, 451/486; 29/402.06; 76/82.1
See application file for complete search history.

(56) References Cited

U.S. PATENT DOCUMENTS

| | | | | |
|---|---|---|---|---|
| 2,048,868 | A | 7/1936 | Johnston | |
| 7,108,595 | B2 | 9/2006 | Reisinger | |
| 7,381,120 | B2 * | 6/2008 | Henry | B24D 15/081 451/523 |
| 11,192,217 | B2 | 12/2021 | Zachariasen | |
| 11,865,662 | B2 * | 1/2024 | East | B24B 3/54 |
| 2006/0141916 | A1 | 6/2006 | McCowen et al. | |
| 2007/0197148 | A1 | 8/2007 | Friel | |
| 2008/0274675 | A1 | 11/2008 | Chen | |
| 2012/0180602 | A1 * | 7/2012 | Murphy | B26B 29/025 76/82 |
| 2018/0178352 | A1 | 6/2018 | Eklund | |

FOREIGN PATENT DOCUMENTS

| | | | |
|---|---|---|---|
| WO | 9605020 | A1 | 2/1996 |
| WO | 2013124705 | A1 | 8/2013 |

OTHER PUBLICATIONS

USPTO; Non-Final Action for U.S. Appl. No. 16/690,191 dated Nov. 25, 2022, 16 pages.
USPTO; Final Action for U.S. Appl. No. 16/690,191 dated Jun. 8, 2023, 10 pages.

* cited by examiner

BLADE SHARPENERS

CROSS-REFERENCE TO RELATED APPLICATION

This application is a continuation application of U.S. patent application Ser. No. 16/690,191 titled "BLADE SHARPENERS", filed on Nov. 21, 2019, which is incorporated herein in its entirety by this reference.

TECHNICAL FIELD

The present disclosure relates to sharpening devices for blades that bend away from the axis of the cutting surface such as helix shaped blades. More particularly, the present disclosure relates to blade sharpeners for reel mower blades for use without mower disassembly. Alternative uses would be to sharpen other cutting surfaces such as auger blades.

BACKGROUND

Manual reel mowers are generally less expensive than motorized lawn mowers to both purchase and maintain. When used on a level or gently contoured well established lawn surface, a reel mower provides a clean, precise, scissor-like cut that users find more aesthetic than that of powered motor that essentially tear grass. Additionally, manual reel mowers are quiet, are easily stored in little space, and are environmentally beneficial over gasoline powered mowers.

Although a typical reel mower requires little maintenance, depending on use, relative to a gasoline powered mower, the blades can become dulled from use as with any cutting tool. Thus, the blades should be sharpened or reconditioned periodically. Currently, consumers typically must disassemble a reel mower to freely access and sharpen the blades, or without the usual disassembly, the user must use a metal file to painstakenly sharpen the blades. Some consumers accordingly delay servicing their mower or see their mower degrade in proficiency and abandon it.

Improvements are needed in devices and methods for sharpening the curved blades of a reel mower without disassembly.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

In at least one embodiment, a blade sharpener for manual use includes: a main body; a first sharpening device pivotally attached to the main body, the first sharpening device having a first channel for receiving a blade to be sharpened; and a second sharpening device pivotally attached to the main body, the second sharpening device having a second channel for receiving a blade to be sharpened. The second sharpening device is pivotable independently of the first sharpening device thereby accommodating any curvature of a blade to be sharpened as the blade sharpener is moved along the blade.

The main body may be configured as a handle.

The first sharpening device and second sharpening device may be pivotable about a common axis.

The first sharpening device may include a first arm, a first slot defined in the first arm and maintained as perpendicular to the common axis, and a first sharpening bit retained in the first slot.

The second sharpening device may include a second arm, a second slot defined in the second arm and maintained as perpendicular to the common axis, and a second sharpening bit retained in the second slot.

In at least one example, the first arm has a first end pivotally attached to the main body, and an opposite second end through which the first channel is defined; and the second arm has a first end pivotally attached to the main body, and an opposite second end through which the second channel is defined.

The first channel and first slot may intersect in the second end of the first arm.

The first end of each of the first arm and second arm may be rounded to accommodate pivoting relative to the main body.

The first sharpening bit and second sharpening bit may include steel.

In at least one example, the main body includes a base and multiple members extending from a first side of the base. Gaps are defined between the members, and the first sharpening device and second sharpening device each has a respective end pivotally positioned in a respective one of the gaps.

Each of the multiple members may have a respective bore formed therethrough along the common axis for receiving at least one fastener pivotally attaching the first sharpening device and the second sharpening device to the main body.

In at least one embodiment, a blade sharpener is provided for use with a powered rotary tool having a rotatable sharpening element. The blade sharpener includes: a main body having a bore for receiving the powered rotary tool, the bore extending through the main body along an axis, the main body further having a first channel for receiving a blade to be sharpened, the first channel being perpendicular to the rotary axis and opening into the bore to permit a blade to be sharpened to engage the sharpening element; and a guide having a guide channel for receiving a blade to be sharpened, the guide being pivotably attached to the main body thereby accommodating any curvature of a blade to be sharpened as the blade sharpener is moved along the blade.

In at least one example, the first channel is defined in a first side of the main body; a second channel perpendicular to the rotary axis and opening into the bore is defined in a second side of the main body opposite the first side; and the guide is pivotally adjustable to align the guide channel with either the first channel in the first side of the main body or the second channel in the second side of the main body.

The guide may include a first end pivotally attached to the main body and an opposite second end through which the guide channel is defined.

The main body may include a mounting member that has a gap in which the first end of the guide is pivotally attached to the main body by way of the mounting member.

In at least one example, a bore is defined through the first end of the guide, and the bore is dimensioned to permit the guide to freely pivot around a fastener that pivotally attaches the guide to the mounting member.

The guide may be pivotally adjustable to align the guide channel with either the first channel in the first side of the main body to sharpen a blade along the first side, or the second channel in the second side of the main body to sharpen a blade along the second side.

The bore of the main body may include: a forward bore section having a first diameter for receiving the sharpening element; and a rearward bore section having a second diameter, being greater than the first diameter, for engaging the rotary tool.

The rearward bore section has internal threads in at least one example.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
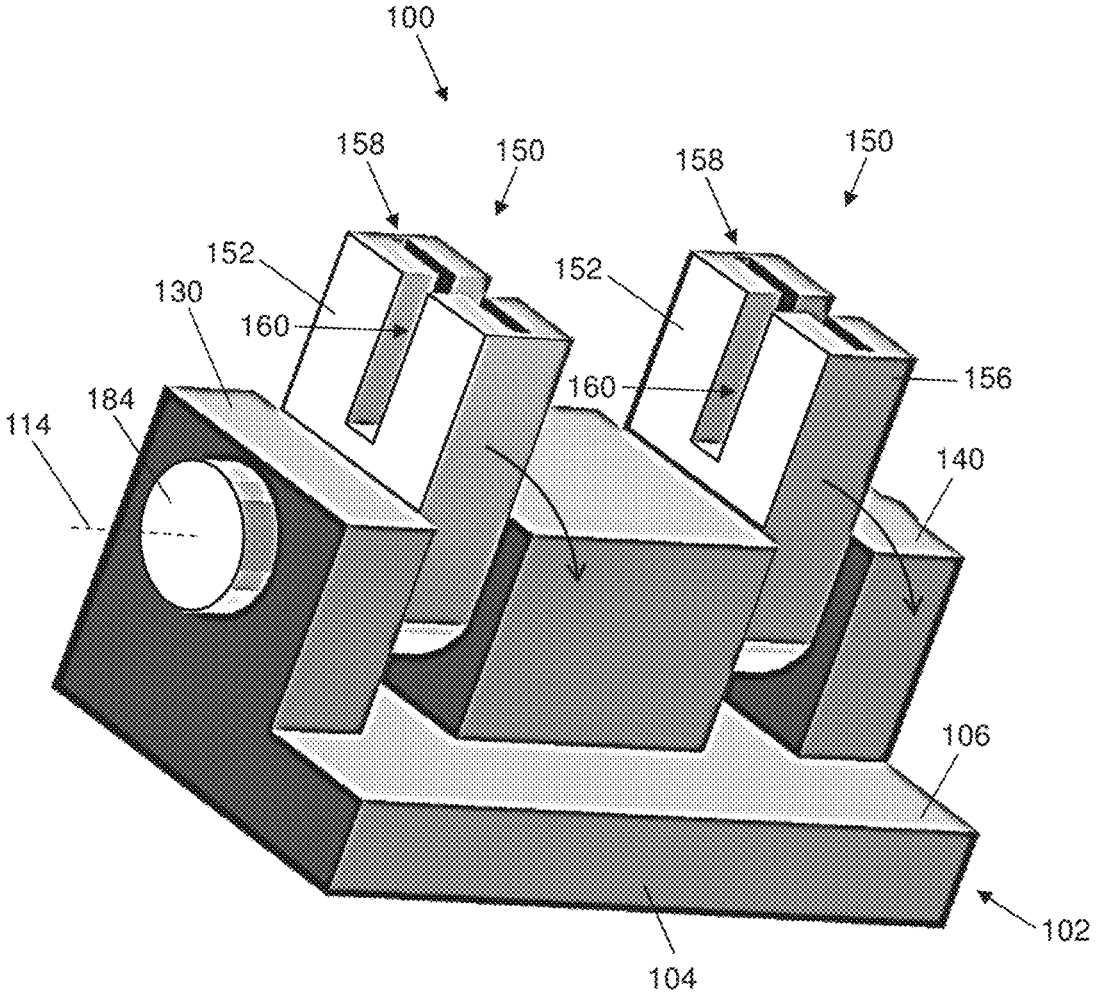
FIG. 1 is a perspective view of a reel mower blade sharpener according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Figure 2:
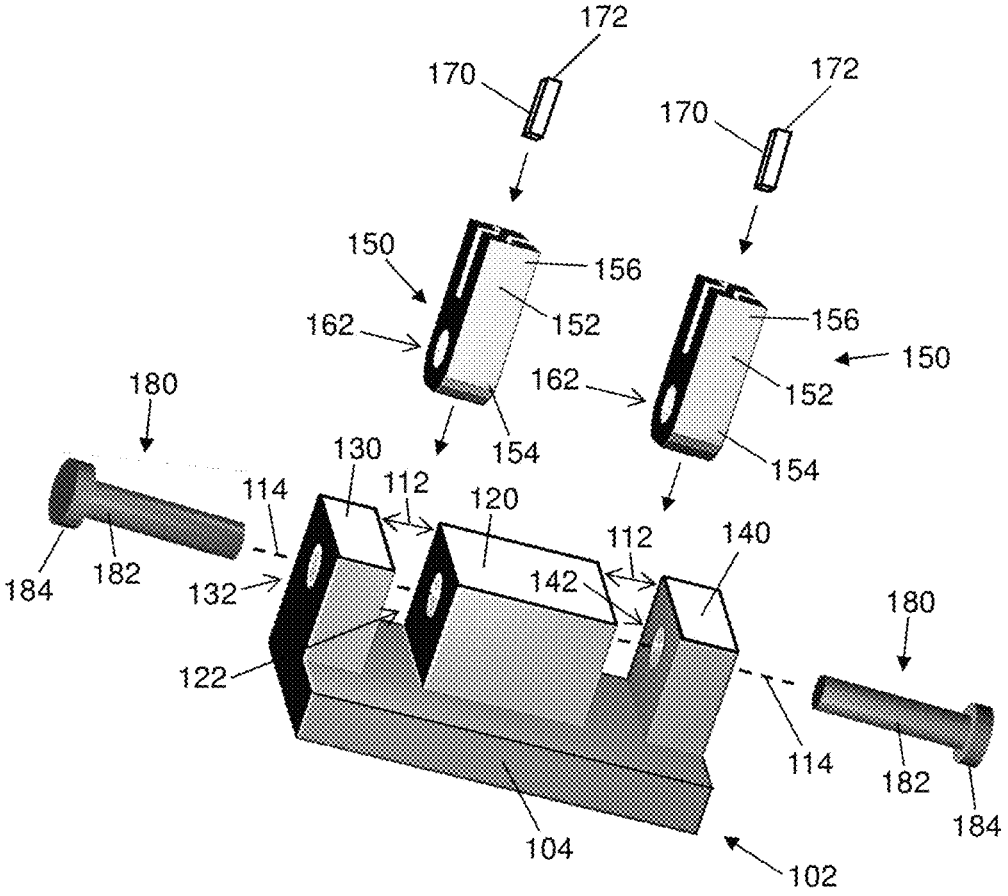
FIG. 2 is an exploded perspective view of the blade sharpener of FIG. 1.

In the drawings as describes below, various embodiments of reel mower blade sharpeners are shown. The blade sharpeners according to the drawings and below descriptions, and related examples and variations thereof that will come to mind in view of this disclosure, advantageously permit the immediate sharpening of the blades of a reel blade assembly and knife bed of a reel mower. In the example of FIGS. 1-2, the innovative arm-like sharpening devices are pivotally mounted to follow the curve of a reel blade allowing the blade to be sharpened without disassembly of a mower. The sharpening devices are placed at the ends of a main body, which serves as a handle, to permit almost full-length sharpening of blades and knife beds. In the example of FIGS. 4-7, the innovative arm-like guide similarly permits guided movement along a curved blade when used with a powered rotary tool. In each example, multiple points of contact with a blade being sharpened maintains optimal orientation and engagement of the bits with the blade for fast and effective sharpening and reconditioning of the blade, and for stability and safe use.

FIG. 1 is a perspective view of a reel mower blade sharpener 100 according to at least one embodiment. The blade sharpener 100 includes a main body 102 that serves as a handle when in use. The main body includes a base 104, which is shown as generally rectangular. Two spaced sharpening devices 150 are pivotally attached to the main body 102 and base 104. The sharpening devices 150 are carried by the body 102, serving as a handle, to move the sharpening devices 150 along a blade to be sharpened.

In the illustrated embodiment, multiple members, which are shown as blocks or pedestals, extend from a first side 106 of the base 104 for attaching the sharpening devices 150. In particular, a central member 120 (FIG. 2) and two end members are shown. A respective gap 112 is defined between the central member 120 and each of the two end members 130 and 140. The central member 120 has a bore 122 defined therethrough along a longitudinal axis 114 about which the sharpening devices 150 pivot to accommodate the curvature of blade being sharpened when the assembled blade sharpener 100 is in use. The first end member 130 similarly has a bore 132 defined therethrough along the axis 114. The second end member 140 similarly has a bore 142 defined therethrough along the axis 114. Thus, the bores 122, 132 and 142 are aligned around the common axis 114. The first end member 130 and second end member 140 are spaced by the gaps 112 from opposite longitudinal ends of the central member 120. In cooperation with at least one fastener, the members 120, 130, and 140 serve as a mounting structure by which the sharpening devices 150 are pivotally attached to the main body 102.

In the illustrated embodiments, each sharpening device 150 is similarly constructed, having an arm 152 that retains an embedded sharpening bit 170, which may be fabricated from hardened tool steel, ceramic, or an abrasive material, as non-limiting examples. A first end 154 of the arm 152 is pivotally attached to the main body 102 within a respective gap 112. The first end 154 is rounded to accommodate pivoting movement without binding with the base 104 of the main body 102.

A second end 156 of the arm 152, opposite the first end 154, can swing around the pivotally attached first end. A slot 158 (FIG. 1) is defined into the second end 156 of the arm 152. The slot 158 is maintained as perpendicular to the axis 114, by the pivotal attachment of the sharpening device 150 to the main body 102. A channel 160 is defined through the second end 154 of the arm 152 perpendicular to the slot 158. The channel 160 receives a blade being sharpened when the blade sharpener 100 is in use. The channel 160 and slot 158 intersect in the second end 156 of the arm 152. As shown in FIG. 1, the channel 160 and slot 158 cross each other as perpendicular.

A bore 162 (FIG. 2) is defined through the first end 154 of the arm 152 to permit pivotal attachment of the sharpening device 150 to the main body 102 by a fastener. A sharpening bit 170 is retained in the slot 158. The slot 158 is maintained as perpendicular to the axis 114 by the pivotal attachment of the sharpening device 150 to the main body 102 to maintain a working facet 172 of the bit 170 in optimal orientation and engagement with a blade being sharpened.

Each sharpening device 150 is pivotally attached to the base 104, in the illustrated example, by a respective fastener 180 illustrated as a pin in the drawings (FIG. 2). Each fastener 180 is illustrated as having a cylindrical shank 182 and a terminal head 184, which has a diameter that is greater than that of the shank 182. To assemble the blade sharpener 100, the first end 154 of each arm 152 is positioned into a respective gap 112. The shank 182 of a first fastener 180 is pressed into the mounting structure through the bore 132 of the first end member 130 until the head 184 contacts the member 130. The shank 182 thereby passes through the bore 162, pivotally attaching a first sharpening device 150 to the main body 102. Similarly, the shank 182 of a second fastener 180 is pressed into the mounting structure through the bore 142 of the second end member 140, pivotally attaching the second sharpening device 150 to the main body 102. The bores 162 formed through the arms 152 are dimensioned to permit the sharpening devices to freely pivot around the shanks 182 and axis 114. The ends of the shanks 182 are received into the bore 122 at opposing ends of the central member 120. The fasteners 180 are retained by press fit engagement with the bores 122, 132 and 142, and/or by threaded engagement for example with the bore 122.

Figure 3:
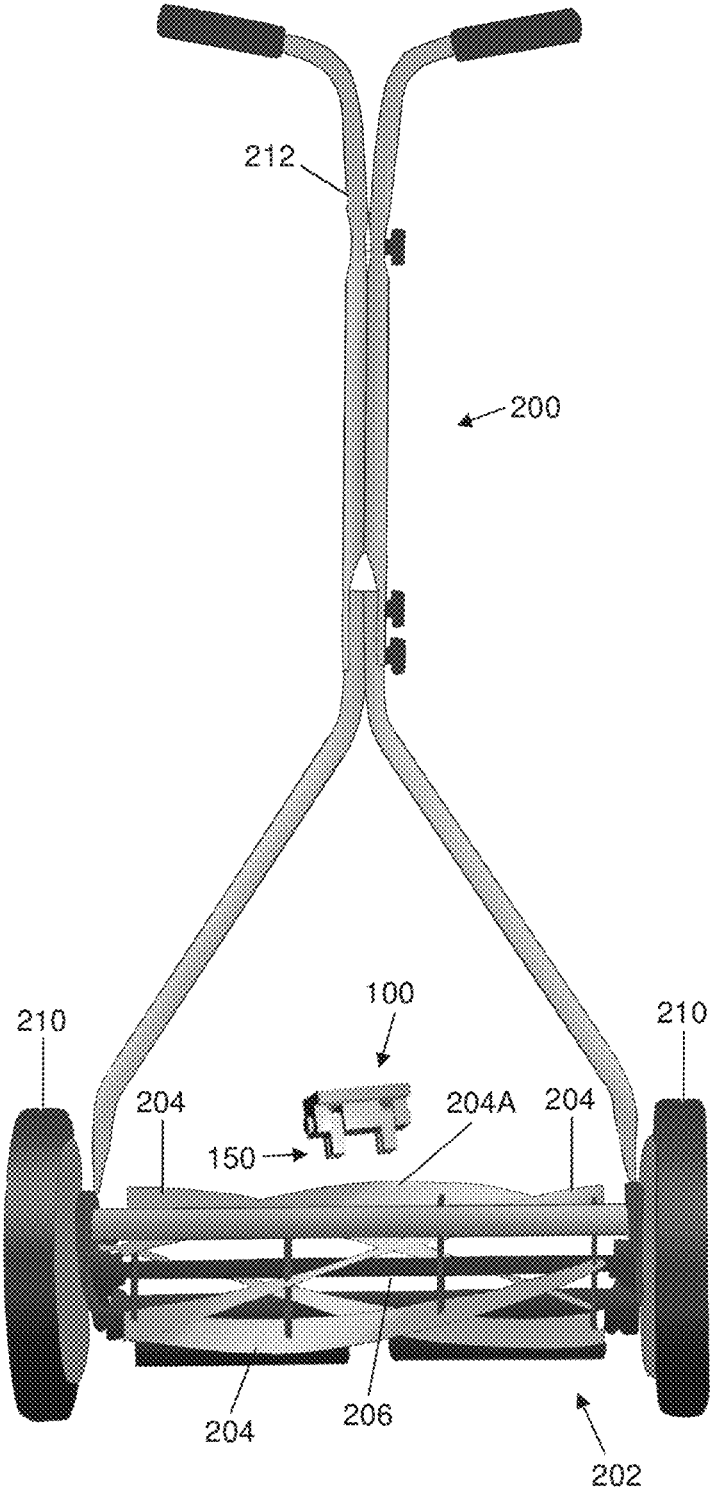
FIG. 3 is a front view of the blade sharpener of FIG. 1 and a reel mower for illustration of use of the blade sharpener.

A reel mower 200 is shown in FIG. 3 for illustration of use of the blade sharpener 100. The reel mower 200 has a reel blade assembly 202 having a generally cylindrical outer silhouette or profile. The reel blade assembly 202 has multiple helical cutting blades 204 attached to a shaft 206 that rotates as ground wheels 210, one at each end of the mower, are turned by user action generally moving the mower 200 along a lawn by use of a fixed handle 212. As the reel blade assembly 202 rotates, the blades 204 scoop grass and other small plant growth toward a fixed straight cutting b (knife bed) that extends along a lower rear periphery of the reel blade assembly profile. The grass and other small plants are cut by scissor action between the rotating blades 204 and the fixed knife bed. A typical reel mower 200 can require frequent or little maintenance depending on the fashion in which it is used. As with any cutting tool, the blades can become dulled from use and incidents may occur in which a rock or other debris nicks a blade. Ultimately, the blades 204 should be sharpened or reconditioned periodically, or upon incident, to improve both immediate performance and the service life of the mower 200. Considerable disassembly may be required, according to the tools and strategy used to sharpen the blades. The reel mower 200 illustrated in FIG. 3 is provided as a non-limiting example for which both the blade sharpener 100 of FIGS. 1-2 and the blade sharpener 300 of FIGS. 4-7 can be used. While a manual mower 200 is illustrated (not motorized), the blade sharpeners 100 and 300, and various embodiments thereof within the scope of these descriptions, may be useful as well for sharpening the blades of motorized mowers and other tools.

Advantageously, the blade sharpener 100 is useful to sharpen or recondition a blade 202 in-situ with the reel blade assembly 202 and mower 200 generally fully assembled. For this use, the blade sharpener 100 is brought into engagement with a selected blade 204A, with the blade received in the channels 160 of the sharpening devices 150. The sharpener 100 can generally be held in a user's hand by the base 204 with the sharpening devices 150 generally extending toward the selected blade 204A. As the sharpener 100 is moved by hand and the selected blade 204A enters the channels 160, the sharpening devices 150 advantageously pivot around the first ends 154 of the arms 152 (FIG. 2) as guided by the blade 204A. Thus, each sharpening device 150, by pivoting independently of the other device 150, accommodates the helical curvature of the blade 204A automatically by passive adjustment to bring the working facet 172 of the respective bit 170 into optimal orientation and engagement with the blade 204A at any particular position of the device 150 along the blade 204A. The two points of contact with the blade defined at the two bits 170 further maintains optimal orientation (ninety degrees for squared profile edged blades) and engagement of the bits with the blade for optimal sharpening and reconditioning of the blade, and for stability and safe use.

Once the blade sharpener 100 is brought into engagement with a selected blade 204A, with the blade received in the channels 160 and the working facets 172 of the bits 170 contacting the blade 204A at their respective locations, the blade sharpener 100 is moved along the helical blade 204A by hand from end to end of the blade. This removes or lessens burrs, nicks, and other damage effects from the blade, effectively sharpening and/or reconditioning the blade for improved use. The sharpening devices 150 both sharpen the selected blade and guide the movement of the blade sharpener 100 along the blade.

The helical curved blades of typical reel mower cut by scissor action against a knife bed and accordingly typically have squared outer profiles defined by ninety degree right angle corners along their outer engagement edges. The working facets 172 of the bits 170 are accordingly squared in embodiments particularly adapted for use in sharpening reel mower blades. In yet other embodiments, blades having chisel point configurations may be accommodated by bits 170 having other working facet profiles. Even in such other embodiments, and in those illustrated or implied in the drawings, the independently pivoting sharpening devices 150 advantageously accommodate the shape of a blade being sharpened automatically by passive adjustment to bring the working facets of the bits into optimal orientation and engagement with the blade as the blade sharpener 100 is moved along the blade.

In the illustrated example, both devices 150 carry a sharpening bit 170. However, in some examples, a first of the devices 150 carries a sharpening bit 170, and the other or second of the devices does not. In such examples, the second device guides the blade sharpener as the first device sharpens the blade.

Figure 5:
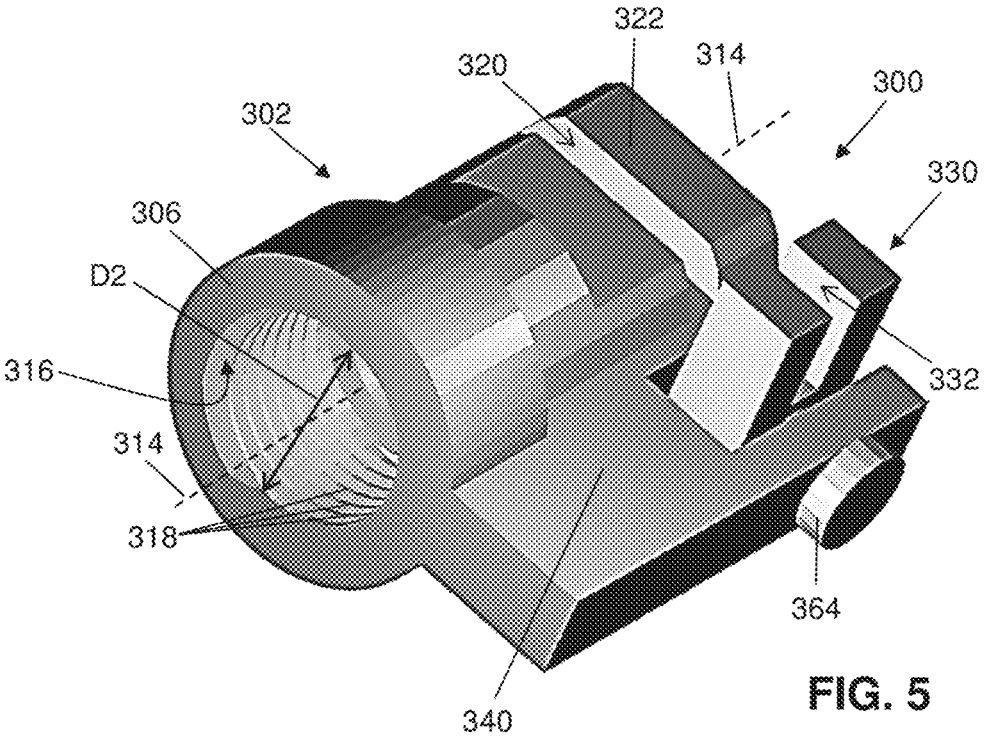
FIG. 5 is a back perspective view of the blade sharpener of FIG. 4.
Figure 6:
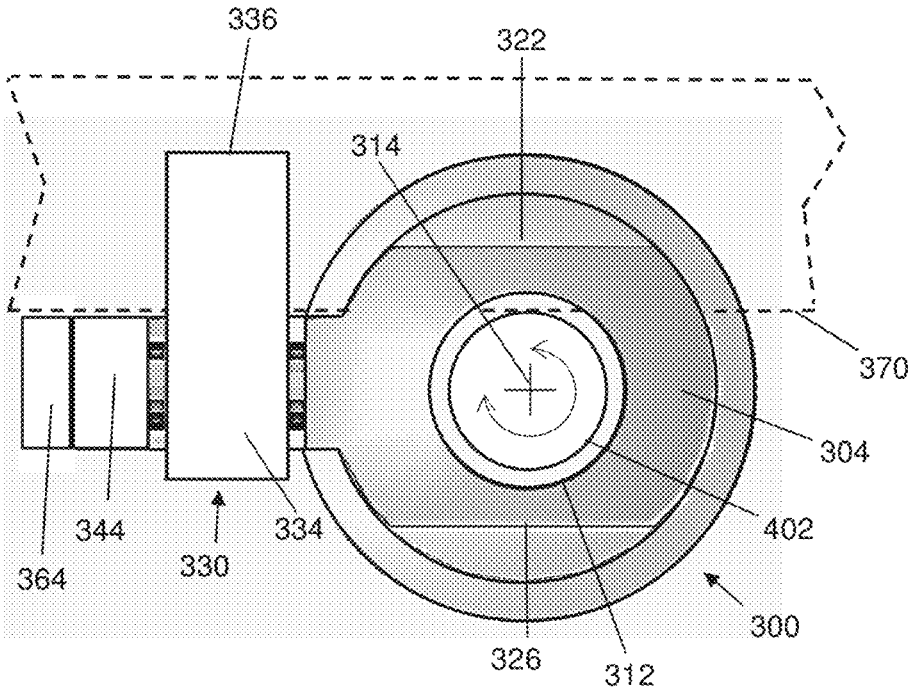
FIG. 6 is a perspective view of the blade sharpener of FIG. 4 shown with a blade in dashed line for an example of use.
Figure 7:
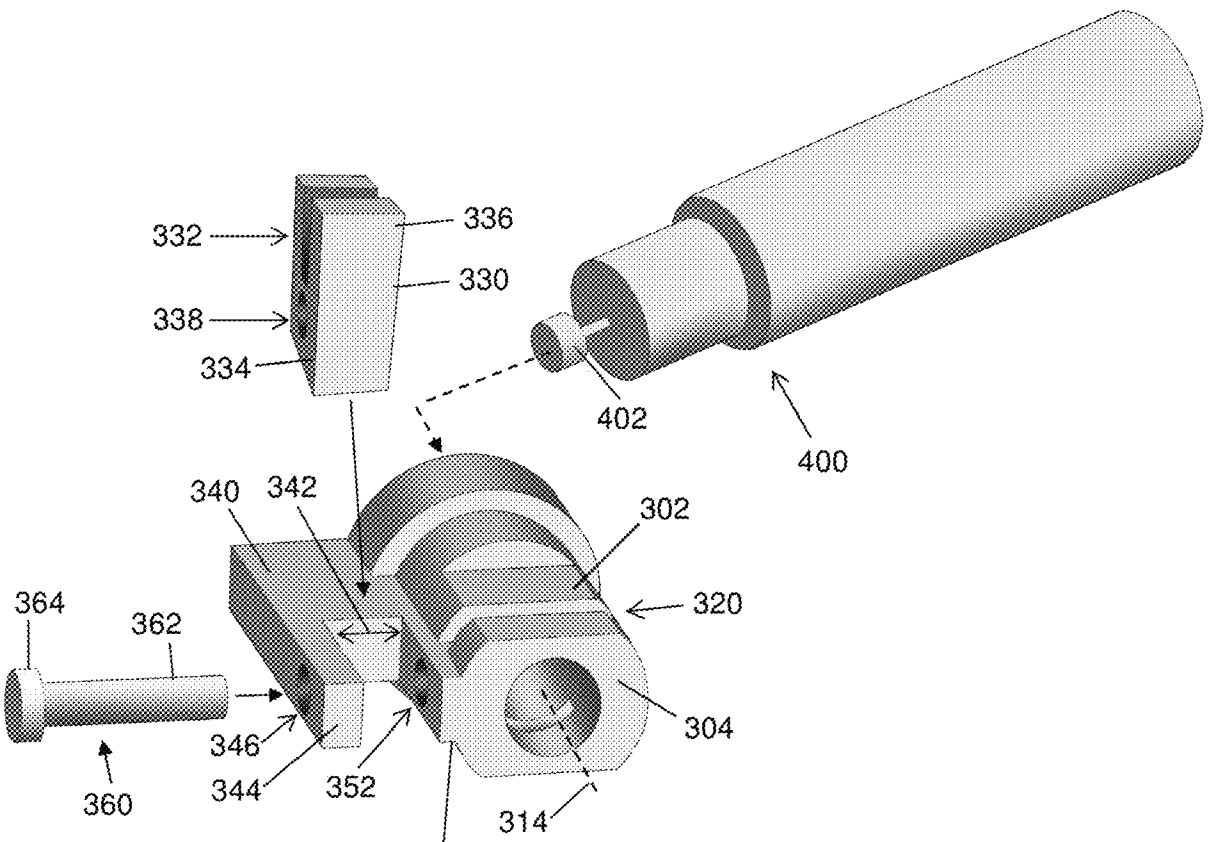
FIG. 7 is an exploded perspective view of the blade sharpener of FIG. 4, shown with a non-limiting example of a rotary tool for illustration of use.

The blade sharpener 100 in the embodiment of FIGS. 1-3 can be described as entirely manual in that the relative movement of the sharpening bits 170 relative to a blade being sharpened is manually applied. In the embodiment of FIGS. 4-7, the blade sharpener 300 is adapted to attach to a rotary tool, such as a Dremel® tool, by which a blade is sharpened by a rotating stone or other bit. A non-limiting example of a powered rotary tool 400 is shown in FIG. 7 for illustration of context and use of the blade sharpener 300.

The main body 302 of the blade sharpener 300 has a forward end 304 and a rearward end 306. A staged bore extends through the main body 302. At the forward end 304, a forward bore section 312 (FIG. 4) has a generally cylindrical interior concentric with a central rotary axis 314 about which a sharpening element such as a cylindrical grinding stone or other sharpening bit rotates to sharpen a blade when the blade sharpener 300 is in use. Such a sharpening element 402 is shown in FIG. 6 as a non-limiting example for illustration of use of the blade sharpener 300. In FIG. 6, the blade sharpener 300 is assumed as mounted on a rotary tool, for example as referenced as the tool 400 illustrated for example in FIG. 7.

At the rearward end 306 of the main body 302 (FIG. 5), a rearward bore section 316 has internal engagement features for engaging the forward section of a rotary tool to attach the tool the blade sharpener 300. The internal engagement features are shown as internal threads 318 in the illustrated embodiment for engaging corresponding external threads on the exterior of the forward end of the housing or handle portion of a rotary tool. The rearward bore section 316 has a greater internal diameter D2 to receive the rotary tool 400, than the internal diameter D1 of the forward bore section 312 that that receives the sharpening element 402.

Channels are defined in opposing sides of the main body 302 near the forward end 304. The channels are dimensioned to receive a blade being sharpened when the blade sharpener 300 is in use. Two channels are provided for flexibility of use of the sharpener 300. A first channel 320 is defined perpendicular to the rotary axis 314 in a first side 322 of the main body 302. A second channel 324, which is perpendicular to the rotary axis 314 and parallel to the first channel 320, is defined in a second side 326 of the main body 302 opposite the first side 322. Each channel 320 and 324 (FIG. 4) is formed through the wall of the main body 302 to open into the forward bore section 312 to permit a blade being sharpened to reach the sharpening element 402 (FIG. 6). The outer opening side of the first channel 320 along the first side 322 of the main body 302, and the inner opening side of the second channel 324 within the forward bore section 312, are expressly shown in FIG. 4. By this reference and symmetry of the main body 302 about a mid plane, it is disclosed that the first channel 320 similarly opens within the bore section 312, and the second channel 324 similarly opens along the second side 326 of the main body 302.

A guide 330 having a guide channel 332 for alignment with either channel 320 or 324 is pivotally attached to the main body 302 by a mounting member 340, which is shown as a block or plate, extending from a third side 328 of the main body 302. A gap 342 (FIG. 7) is defined in the mounting member to receive the guide 330. The gap 342 opens forward with respect to the forward end 304 of the main body 302. Two portions of the mounting member 340 are spaced by the gap 342. A distal portion 344 of the mounting member 340 has a bore 346 defined therethrough perpendicular to the rotary axis 314. A proximal portion 350 of the mounting member 340 is connected to the main body 302 and has a bore 352 defined therethrough perpendicular to the rotary axis 314. The bore 352 is aligned with the bore 346. In cooperation with a fastener, the mounting member 340 pivotally attaches the guide 330 to the main body 302.

The guide 330 is illustrated as an arm, having a first end 334 (FIG. 7) pivotally attached to the mounting member 340 within the gap 342. A second end 336 of the guide 330 opposite the first end 334, can swing around the pivotally attached first end 334. The guide channel 332 is defined in the second end 336. A bore 338 is defined through the first end 334 of the guide 330 to permit pivotal attachment to the mounting member 340 by a fastener.

The guide 330 is pivotally attached to the mounting member 340 by a fastener 360 illustrated as a pin in the drawings. The fastener 360 is illustrated as having a cylindrical shank 362 and a terminal head 364, which has a diameter that is greater than that of the shank 362. To assemble the blade sharpener 300, the first end 334 of the guide 330 is positioned into the gap 342. The shank 362 of the fastener 360 is pressed through the bore 346 until the head 364 contacts the mounting member 340. The shank 362 thereby passes through the bore 338, pivotally attaching the guide 330 to the main body 302 by way of the mounting member 340. The bore 338 formed through the guide 330 is dimensioned to permit the guide 330 to freely pivot around the shank 362. The end of the shank 362 is received into the bore 352. The fastener 360 is retained by press fit engagement with the bores 346 and 352, and/or by threaded engagement for example with the bore 352.

Figure 4:
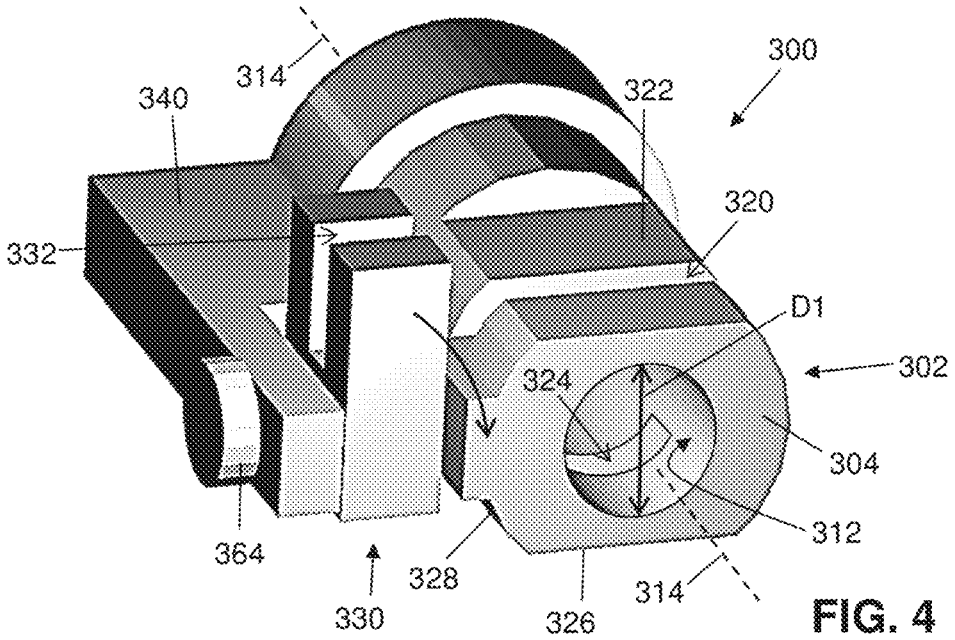
FIG. 4 is a front perspective view of a reel mower blade sharpener according to at least one other embodiment.

The guide 330 is pivotally adjustable to align the guide channel 332 with either the first channel 320 in the first side 322 of the main body 302, or the second channel 324 defined in the second side 326 of the main body 302, a blade to be sharpened can be accommodated and guided along either side of the main body 302. A blade 370 being sharpened is shown in dashed line in FIG. 6 for a non-limiting example of use of the blade sharpener 300. In the position of the guide 330 as illustrated in FIGS. 4-6, the guide channel 332 thereof is aligned with the first channel 320 in the first side 322 of the main body 302 to sharpen the blade along the first side 322. The guide 330 is similarly pivotable to align the guide channel 332 thereof with the second channel 324 in the second side 326 of the main body 302 to sharpen the blade along the second side 326. Thus, the guide 330 can lead or follow the main body 302 and sharpening element 402 as the blade sharpener 300 is moved along the blade 370 being sharpened.

By pivoting relative to the main body 302, the guide 330 accommodates the helical curvature of the blade 350 automatically by passive adjustment to permit the working face of the sharpening element 402 to be held in optimal orientation (ninety degrees for squared profile edged blades) and engagement with the blade 370 as the blade sharpener 300 is moved along the blade. The guide 330 and aligned channel 320 or 324 together provide multiple points of contact with the blade for optimal sharpening and reconditioning of the blade, and for stability and safe use.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A blade sharpener for manual use comprising:

a main body configured as a handle, the main body comprising a base and multiple members extending from a first side of the base, wherein at least a first gap and a second gap are defined between the multiple members, the first gap and the second gap are separated by at least one of the multiple members, wherein a longitudinal axis is defined through each of the multiple members, the first gap and the second gap;

a first sharpening device positioned in the first gap, wherein the first sharpening device is pivotally attached to at least two of the multiple members and pivots about the longitudinal axis, wherein the first sharpening device has a first channel extending through an end opposed to that disposed in the first gap, wherein the first channel extends along a first line parallel to the longitudinal axis and is configured to receive a portion of a blade to be sharpened, and wherein a segment of the first channel is defined through a first sharpening bit mounted in the first sharpening device; and a second sharpening device disposed in the second gap and pivotally attached to at least two of the multiple members to pivot about the longitudinal axis, wherein the second sharpening device has a second channel extending through an end opposed to that in the second gap and along a second line parallel to the longitudinal axis.

2. The blade sharpener of claim 1, wherein the second sharpening device is pivotable independently of the first sharpening device thereby accommodating any curvature of the blade to be sharpened as the blade sharpener is moved along the blade.

3. The blade sharpener of claim 1, wherein the second sharpening device is configured to guide the blade sharpener as the first sharpening device sharpens a portion of the blade.

4. The blade sharpener of claim 1, wherein the second sharpening device further comprises a second sharpening bit mounted therein and through which a portion of the second channel is defined for sharpening a portion of the blade.

5. The blade sharpener of claim 4, wherein the second sharpening bit is mounted within a respective slot extending perpendicular to the second channel.

6. The blade sharpener of claim 1, wherein a cross section of the base is rectangular.

7. The blade sharpener of claim 1, wherein the end of the first sharpening device disposed in the first gap comprises a surface that is rounded around the longitudinal axis to accommodate pivoting relative to the base.

8. The blade sharpener of claim 1, wherein the end of the second sharpening device disposed within the second gap comprises a surface that is rounded around the longitudinal axis to accommodate pivoting relative to the base.

9. The blade sharpener of claim 1, wherein the width of the first side of the base, in a first direction perpendicular to the longitudinal axis and parallel to a plane in which the first side is disposed, is greater than the width of each of the multiple members, in the first direction, such that a portion of the first side extending away from each of the multiple members forms a portion of a lip.

10. The blade sharpener of claim 1, wherein depth of the base, in a first direction perpendicular to the first side is less than the depth of each of the multiple members extending away from the first side.

11. The blade sharpener of claim 1, wherein at least two of the multiple members extend away from the first side of the base an identical distance.

12. The blade sharpener of claim 1, wherein the first sharpening device is removably attached to the at least two of the multiple members and configured to be selectively removed from the first gap to allow the first sharpening device to be replaced with another.

13. The blade sharpener of claim 1, wherein the second sharpening device is removably attached to the at least two of the multiple members and configured to be selectively removed from the second gap to allow the second sharpening device to be replaced with another.

* * * * *